US005178387A

United States Patent [19]

Kuebler

[11] Patent Number: 5,178,387

[45] Date of Patent: Jan. 12, 1993

[54] RACKET FOR BALL GAMES, IN PARTICULAR A TENNIS RACKET

[76] Inventor: Siegfried Kuebler, Mozartst. 17, D777 Ueberlingen, Fed. Rep. of Germany

[21] Appl. No.: 680,946

[22] Filed: Apr. 5, 1991

[30] Foreign Application Priority Data

Jul. 27, 1990 [DE] Fed. Rep. of Germany ..... 4023906

[51] Int. Cl.[5] ..... A63B 49/08

[52] U.S. Cl. ..... 273/73 J; 273/73 R

[58] Field of Search ..... 273/73 R, 75, 81 R, 273/80 R, 80 B

[56] References Cited

U.S. PATENT DOCUMENTS

| | | | |
|---|---|---|---|
| 1,535,667 | 4/1925 | Horne | 273/80 B |
| 1,828,109 | 10/1931 | Fox | 273/73 J |
| 2,000,316 | 5/1935 | Bentley | 273/73 J |
| 2,001,166 | 5/1935 | Swennes | 273/80 R |
| 2,126,717 | 8/1938 | Barnhart | 273/80 B |
| 3,972,529 | 8/1976 | McNeil | 273/80 B |
| 4,082,273 | 4/1978 | Ellzly | 273/73 J |
| 4,205,844 | 6/1980 | Goarbas | 273/73 J |
| 4,367,871 | 1/1983 | Schiefer | 273/73 J |
| 4,660,832 | 4/1987 | Shomo | 273/73 J |
| 4,811,947 | 3/1989 | Takatsuka et al. | 273/732 |
| 4,953,861 | 9/1990 | Nakanishi | 273/73 J |

FOREIGN PATENT DOCUMENTS

| | | | |
|---|---|---|---|
| 458103 | 12/1936 | United Kingdom . | |
| 2163963 | 3/1986 | United Kingdom | 273/73 J |
| 2225538 | 6/1990 | United Kingdom | 273/73 J |

*Primary Examiner*—V. Millin
*Assistant Examiner*—Raleigh W. Chiu
*Attorney, Agent, or Firm*—Bachman & LaPointe

[57] ABSTRACT

A racket for ball games, in particular a tennis racket, comprising stringing provided in a stringing frame comprising a profile bar, a throat region adjoining the stringing and a handle (20) on a racket shaft on the longitudinal axis of the racket, which preferably forms a straight line of symmetry, is improved in regard to so-called impact shock in that the racket, between the throat region and the end of the handle (20), has a hinge location (44) whose hinge axis extends parallel to the stringing. The hinge location (44) is preferably disposed in the region of the handle (20) and is formed by a limb portion of the handle (20) which is preferably defined on both sides by groove-like channels (40) and is filled by an elastic shaped mass (42).

11 Claims, 2 Drawing Sheets

Fig.1
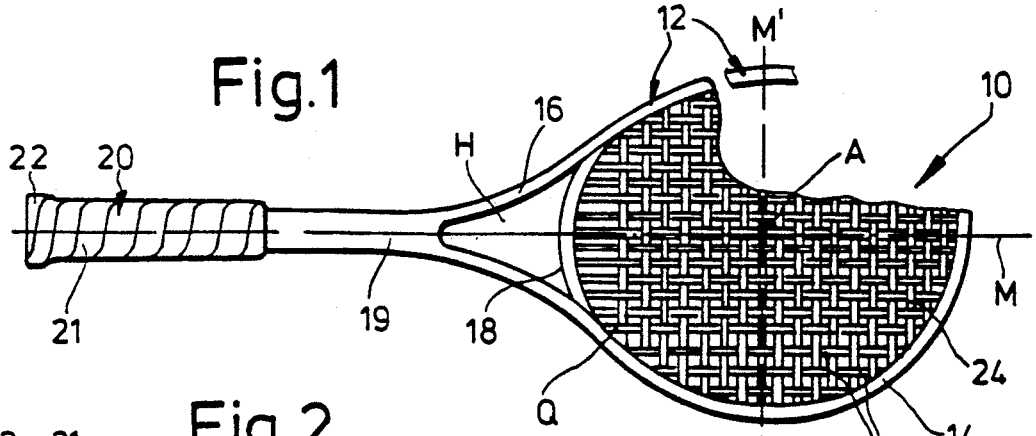
Fig.2
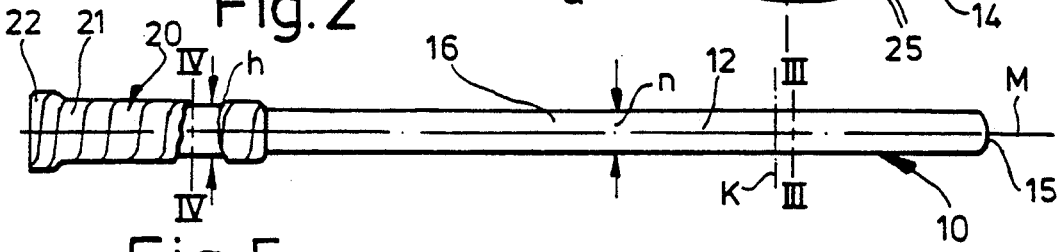
Fig.5
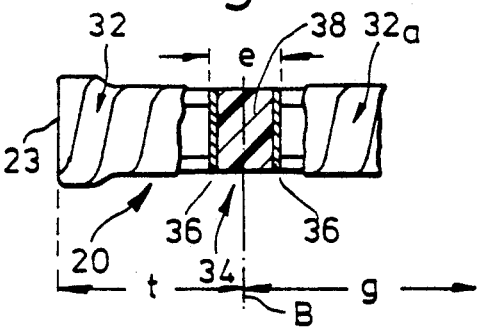
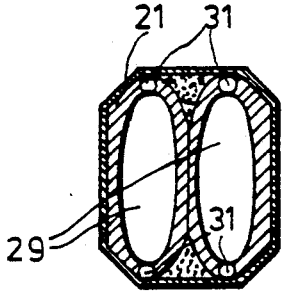
Fig.4
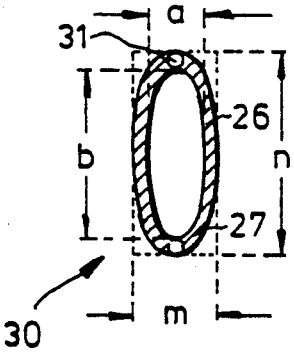
Fig.3
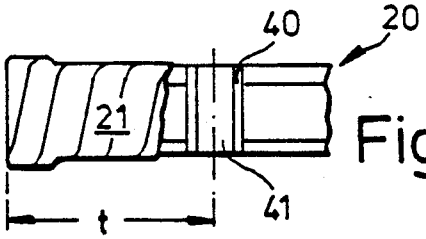
Fig. 6
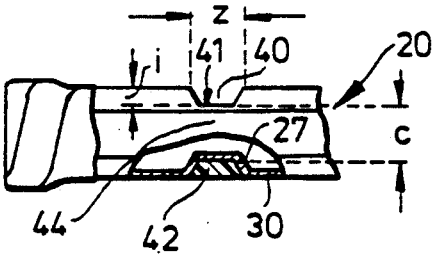
Fig.7
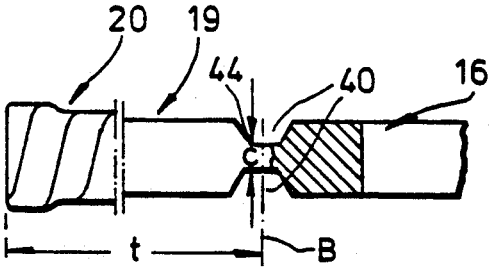
Fig.8

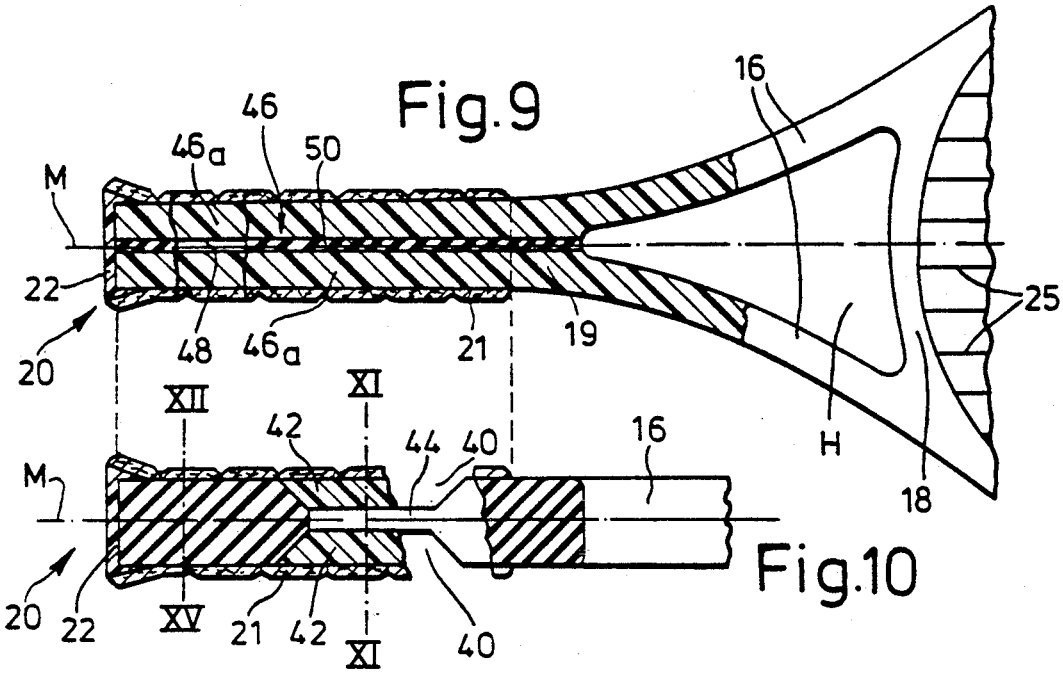
Fig.9
16
46
46a
50
M
22
20
48
46a
21
19
25
XII
XI
42
44
40
16
H
18
M
20
22
XV
21
42
XI
40
Fig.10
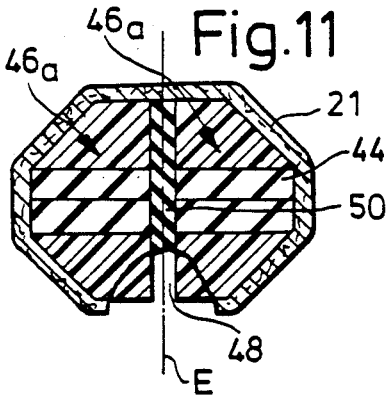
Fig.11
46a
46a
21
44
50
48
E
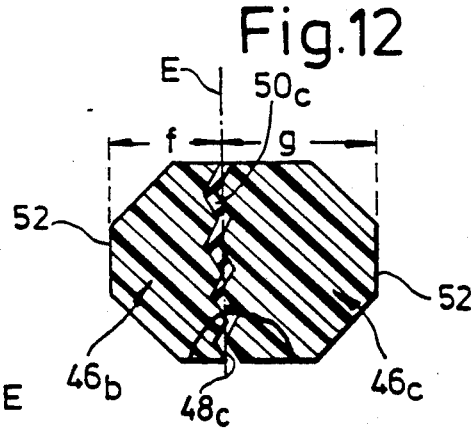
Fig.12
E
50c
f
g
52
52
46b
48c
46c
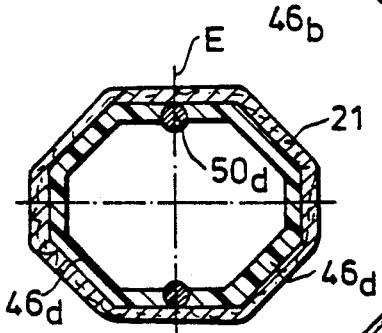
E
21
50d
46d
46d
Fig.13
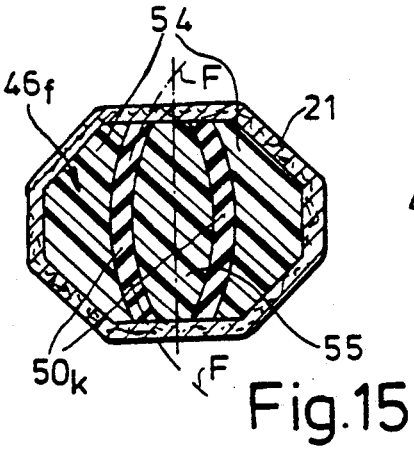
54
F
46f
21
50k
F
55
Fig.15
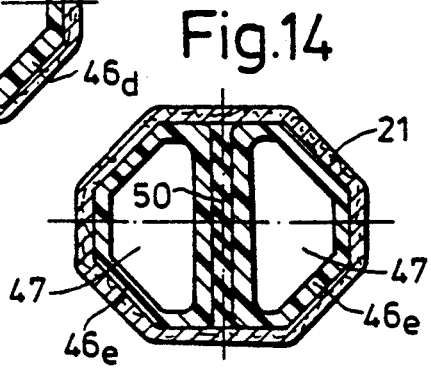
Fig.14
21
50
47
47
46e
46e

RACKET FOR BALL GAMES, IN PARTICULAR A TENNIS RACKET

DESCRIPTION

The invention relates to a racket for ball games, in particular a tennis racket, comprising stringing in a stringing frame comprising a shaped bar, a throat region which adjoins the stringing and a handle on a racket shaft on the longitudinal axis of the racket which preferably forms a straight line of symmetry, wherein the free end of the handle is defined by a handle end face.

Tennis rackets of that kind are to be found for example in German laid-open application (DE-OS) No 30 18 354. When clamped in the region of the handle, tests showed that they have a natural frequency of between 25 and a maximum of 50 Hz; unstrung tennis rackets generally have slightly higher values. The frequency of the overall system comprising the racket and the stringing has a substantial influence on the hand which is playing with the racket and thus also on the occurrence of what is known as tennis elbow.

In consideration thereof the inventor set himself the aim of eliminating or at least alleviating the influences acting on the hand of the person playing with such a racket, in particular the so-called impact shock which occurs upon contact with the ball, without in that respect giving up the advantages of a very stiff frame, as are afforded for example by rackets in accordance with German patent specification No 3 343 898.

That object is attained by the concept that the racket has a hinge location between the throat region and the end face of the handle and the hinge axis extends parallel to the stringing, that is to say in the plane defined by the racket frame. In other words, provided at the pivot point which occurs or adjacent that pivot point, in the racket shaft or in the handle, is an elastic hinge location which alters the frequency characteristics of the racket and compensates for impact shock.

The above-mentioned pivot point of the racket when a ball is struck is referred to in the language in the art as the 'pivot point of rotation'. No forces occur at that point but a turning moment acts thereabout. When the ball hits the racket, forces in the direction of the arriving ball act on the racket, as viewed from that point towards the head end of the racket. From the pivot point towards the end of the handle however the forces act in the opposite direction. Therefore, when playing a forehand, a racket tends to tilt out of the player's hand whereas when a backhand stroke is played it tends to force itself into the palm of the hand. That is possibly the reason why players suffering from what is known as tennis elbow can hit a forehand stroke in a relatively pain-free manner but pain occurs to a greater extent when playing a backhand.

It has been found advantageous for the above-indicated hinge location to be disposed in the region of the handle although it is also in accordance with the invention for the hinge location to be displaced out of the handle region; thus, in accordance with the invention, the elastic hinge can be disposed in a range of distance of 60 through 200 mm from the end face of the handle. That is also the region in which the abovementioned pivot point lies.

In accordance with the invention the hinge location is formed by a block of elastic material, a rubber block, which is preferably vulcanized at both ends on to plates of the handle portions and connects two portions of the handle.

In another embodiment of the invention the hinge location is a limb portion of the handle or the racket shaft, which is delimited on both sides by groove-like channels formed therein. The width of the channel or groove, as measured in the longitudinal axis of the racket, may be up to 100 mm but it will generally be considerably shorter. In that connection the depth of the limb portion approximately corresponds to the depth of the channel formed in the racket, which presupposes that the shaft cross-section is divided into three portions of approximately equal width.

Preferably the two grooves of that construction are filled by a shaped mass of low flexural stiffness, particularly when the two grooves are provided in the handle region and must be covered by the handle leather.

The object according to the invention is also obtained by a racket with a plurality of parallel axes, which are directed transversely with respect to the longitudinal axis of the racket, of adjacent hinge locations. In that arrangement flexing in the elastic region of the racket which is clamped fast as far as the first hinge location at the handle, under the effect of a force which acts at a spacing of 400 mm from the hinge axis towards the head, is to be between 1.2 and 9 times as great as the flexing of a hinge-less racket, which however is otherwise of corresponding configuration, when it is fixedly clamped at the handle, as far as the hinge axis.

Advantageously the hinge location or locations produces or produce a reduction in the frequency of a racket which is fixedly clamped as far as the first hinge at the handle by between $\sqrt{1.2}$ and $\sqrt{9}$ relative to an identical racket without a hinge location.

Tennis rackets with an open throat region which is defined by two profile portions with a frame limb portion connecting same, and of increased cross-section in the region thereof, which have proven in practice to be extremely effective, can be made even more efficient by virtue of the provision of at least one such hinge location.

An aspect of additional significance to the present invention is the possibility of providing the racket shaft and a shaft portion forming the handle with at least one gap which extends continuously into the throat region and which contains at least in a portion-wise manner an elastic mass which bears at both sides against the surfaces which delineate the gap in the shaft, constituting an intermediate layer or intermediate element between the bar parts of the shaft. In accordance with a further feature of the invention, as viewed in cross-section, the intermediate layer may also comprise a plurality of strips or cord portions which leave cavities or gaps free between them. In a particular embodiment there is provided a round cord portion which holds the two associated shaft bar parts at a spacing and keeps the remaining portions of the gap in the shaft free.

In addition it has proven to be advantageous for the elastic material to bear at both sides against the surfaces defining the gap in the shaft and for the bar parts of the shaft to be at least partially laterally movable relative to each other in the direction of striking.

With a symmetrical racket design configuration, separation of the handle is parallel to the direction of striking or perpendicular to the striking surface and preferably along the longitudinal axis of the racket. If the separating gap in the shaft is outside the center line, or is curved, inclined or of a zig-zag configuration, the damping results which can be achieved are admittedly not quite so good but they are still acceptable. Thus, in accordance with a further feature of the invention, the substantially rectangular cross-section of the gap in the shaft extends linearly in a plane or surface, but the cross-section can also be of a wavy or zig-zag configuration.

The elastic connecting elements of correctly separated shaft or handle bar parts may be continuous, consisting for example of a silicone rubber layer. However it is also possible to envisage them being arranged in a punctiform fashion or only in a strip-like configuration for example at the cut edge or the ends of the gap. The connecting elements may be produced from hose or tube portions, round rubber cord portions or resiliently in some other way. It is also possible to envisage a partial opening, for example slots, which can also be unfilled; a firm connection could remain only at the end of the handle, while the slot disposed thereabove could contain a damping material.

It has proven to be advantageous for the described surface to be of a flat configuration. In a particular construction the surface is curved in cross-section, and a plurality of surfaces may be associated with each other.

Depending on the respective design configuration of the racket according to the invention, flat bar portions of elastic material are used, which are linear or curved in cross-section and which, as described, may entirely or only partially fill the gap in the shaft.

Therefore, an elastic connection, or interruption, is put into the handle or the center line thereof, to absorb and damp the torsion effect in the lower region of the racket. That eliminates inter alia the disadvantages involved in handles which are foamed on the racket, with a virtually elastic characteristic, namely making the racket 'soft' in its longitudinal direction, so that the oscillation characteristics are altered, the degree of striking precision deteriorates and the positive properties referred to, in a super-hard racket, are lost. If the handle which is otherwise made from more or less non-elastic materials such as for example wood, metal, pressed fibers in a plastic bed, plastic materials or hard foam, is separated along the center line or axis of symmetry or closely adjacent thereto substantially perpendicularly to the striking surface, and re-joined for example with an elastic mass such as silicone rubber, that alters the hardness of the racket in its longitudinal direction just as little as the oscillation characteristics of the racket. The latter are also not altered when the ball is hit on the longitudinal axis of the racket. However in the case of balls which hit the striking surface of the racket outside that axis, torsional oscillations are produced; admittedly, those torsional oscillations are superimposed on the longitudinal oscillation, but then, due to the resulting relative movement of the shaft and handle bar portions relative to each other, they are damped and suppressed by means of the elastic intermediate layer and can thus pass to a lesser degree into the striking arm. The connection of the ends of the handle by the handle cap which is principally not divided or also comprises elastic material, and the influence of a handle leather which is wrapped around the handle, must also be taken into account when selecting the required elasticity of the intermediate layer. Tests have confirmed that rackets of such a construction reduce the impact shock when balls are struck at an off-center position, and give an improved 'feel for the ball'. This invention can substantially eliminate the disadvantages of super-hard rackets while however maintaining the advantages thereof.

Further advantages, features and details of the invention are apparent from the following description of preferred embodiments and with reference to the drawings in which:

FIG. 1 is a plan view of part of a tennis racket with a head comprising a hollow profile bar and a handle on a racket shaft, FIG. 2 is a side view of the FIG. 1 racket, FIG. 3 is a view on an enlarged scale in cross-section through FIG. 2 taken along line III—III therein, FIG. 4 is a view on an enlarged scale in cross-section through FIG. 2 taken along line IV—IV therein, FIGS. 5 and 6 show two partial sectional plan views of handles on an enlarged scale in comparison with FIGS. 1 and 2, FIGS. 7 and 8 show various partial sectional side views of handles on an enlarged scale, FIG. 9 shows a view of a portion from FIG. 1 on an enlarged scale, in another embodiment, FIG. 10 shows the portion illustrated in FIG. 9, turned through 90°, FIGS. 11 through 15 show views on an enlarged scale in cross-section through the handle taken along line XI—XI in FIG. 10, and line XII-XV for FIGS. 12-15 in relation to different constructions, and FIG. 16 is a partial sectional view showing a plurality of hinge locations.

A tennis racket 10 which is shown by way of example in FIGS. 1 through 4 has an oval racket head or stringing frame 14 formed by a suitably curved profile bar 12. The profile bar 12 of the racket head 14 terminates on both sides of the longitudinal axis M of the racket in profile arms 16 which laterally delimit an open throat region H and which are connected by a frame limb portion 18 and which go into a racket shaft 19.

Adjoining the racket shaft 19 is a handle 20 of a thickness h of from about 26 through 32 mm; that thickness h is measured on the handle 20 without a wrapping leather 21 and without taking account of a handle cap 22 which in FIGS. 1 and 2 is covered by the leather.

The racket head 14 and the limb portion 18 define a stringing area or surface Q comprising transverse strings 24 and longitudinal strings 25 which cross the transverse strings 24. The preferred point of impact A for a tennis ball (not shown) lies in FIG. 1 approximately at the point of intersection of the longitudinal axis M of the racket and transverse line M', and in FIG. 2, approximately on a line K.

The racket head 14 or its hollow profile bar 12 is substantially of extended oval cross-section, the side walls 26 thereof extending at an internal spacing as indicated at a of for example 8 mm (outside width m about 10 mm) and blending into arcuate portions 27 with an internal profile height b of 20 mm and an external profile height as indicated at n of in this case about 25 mm.

The profile bar 12 is formed from a tubular blank 30 in which longitudinal fiber strands 31 are arranged in the arcuate portions 27. The ends of the blank 30 are brought together at the racket shaft 19 in such a way that two chambers 29 are formed in the shaft and in the handle 20. The two ends of the blank 30, as shown in FIG. 4, form the octagonal cross-section of the handle 20.

In the embodiment shown in FIG. 5 the handle 20 is made from two portions 32 and **32*a* which are connected together at a spacing e by an elastic intermediate portion 34. The latter comprises two transverse plates 36 of metal or another suitable material, and a rubber block 38 which is fixedly vulcanized thereon. It forms a hinge location of limited flexibility, the hinge axis B of which extends at a spacing t of from 60 through 220 mm relative to the end face 23 of the handle cap 22, constituting the end face of the handle. The spacing of the hinge axis B from the end 15 of the racket head 14** is identified by g.

The hinge location shown in FIGS. 6 and 7 is defined by grooves 40 of a greatest width as indicated at z, the grooves 40 being formed at both sides in the handle 20 and reducing in size towards the axis M of the handle. The grooves 40 are filled for example by plastic blocks 42 with a low level of flexural stiffness. The depth i of the grooves 40 in FIG. 7 is somewhat shorter than the thickness c of an intermediate portion 44 which remains in the handle 20; the surfaces of the intermediate portion 44 each form the lowest point 41 of the respective groove. Moreover longitudinal strands or cords 31 of the blank 30 are laid around the grooves 40 and are therefore not interrupted at the hinge location.

In FIG. 8 the hinge location comprising the intermediate limb portion 44 which is flanked by the grooves 40 is disposed adjacent the end of the racket shaft 19.

If the thickness c of the intermediate limb portion 44 which is formed by the grooves 40 over the length z and which does not only have to be of the shape shown in the illustrated embodiment measures about half the thickness h of the handle 20, the flexing which occurs in response to a force acting on the racket, by virtue of the lower moment of inertia in the cross-section of the limb portion, per unit of length, is about 4.3 times as high as the flexing which occurs with a full handle cross-section if the modulus of elasticity is assumed to be unaltered; moreover the degree of flexing is inversely proportional to the product of the moment of inertia×modulus of elasticity.

If the thickness c of the limb portion is only one third of the thickness h of the handle 20, the corresponding value is 12.5 and finally, at a one quarter situation, it is twenty times as high. Those initially calculated values are confirmed upon measurements carried out on corresponding racket configurations, a preferred measurement in respect of the thickness c being when it measures about 4 through 6 mm, that is to say the thickness h of the handle 20 is between five and eight times the thickness c. The thickness of the handle may be between 4 and 10 times the thickness c of the limb portion 44.

The hinge location 34 must be fairly elastic in order to cause small variations in frequency. That will now be described by means of an example with reference to the construction shown in FIGS. 5 and 6.

The thickness c of the limb portion 44 should be half the thickness h of the handle of the tennis racket 10, with the width z being 20 mm. The spacing t from the handle end 23 is fixed at 120 mm. The ball hits the stringing Q at the location A which in the illustrated example is 400 mm away from the hinge axis B. For the sake of simplicity it is assumed that the moment of inertia for the full handle cross-section is unaltered for all racket cross-sections, that is to say over the entire length of the racket, no torsional moments occur and the modulus of elasticity remains constant. Calculation shows that flexing of the tennis racket 10 with the above-described hinge location 34 under the force of a ball acting thereon is 1.22 times as high as that of an identical racket without hinge. The frequency of the tennis racket would then change with the reciprocal value of the root of the flexing. If the tennis racket 10 had a frequency of 80 Hz, the racket provided with that hinge would have a frequency of $80\times 1/\sqrt{1.22}$ Hz, that is to say 72.5 Hz.

A further example is intended to show how it is possible to achieve a greater drop in frequency.

The height c of the limb portion is selected to be a quarter of the thickness h of the handle, with the width z being 100 mm. In other respects the data of the first example apply.

In this case the degree of flexing being sought would be six times as great and the frequency being sought would also be six times lower, that is to say only 33 Hz instead of 80 Hz. That frequency relates to a tennis racket 10 which is fixedly clamped as far as the first hinge at the handle 20.

In the embodiment shown in FIGS. 9 and 10 the racket shaft 19 and the adjoining shaft portion of the handle 20 are symmetrically divided in the direction of the longitudinal axis M of the racket, that is to say each of the profile arms 16 is extended with its own shaft bar part $46_a$ in the handle 20, wherein the two shaft bar parts $46_a$ together determine the external contour of a handle shaft portion 46 and delimit between them a shaft gap 48 which, as shown in FIG. 9, accommodates an elastic intermediate layer 50 and defines a plane E which passes through the stringing surface or area Q, substantially perpendicularly in FIGS. 11 through 14.

In the embodiment shown in FIGS. 9 through 11 the shaft bar parts $46_a$, apart from the hinge location 40/44, are symmetrical full profiles with an interposed strip of elastic material as a filling intermediate layer 50 in the shaft gap 48 which is here linear in cross-section, whereas FIG. 12 shows shaft bar parts $46_b$, $46_c$ of different cross-sectional configurations, with between them, and at different spacings f, g relative to the side contours 52, a shaft gap $48_c$ which is of a substantially wavy or corrugated configuration and which is entirely filled by the elastic intermediate layer $50_c$.

FIG. 13 shows a handle 20 with a hollow profile which is divided symmetrically in the plane E into shaft bar parts $46_d$, with an elastic round strand or cord $50_d$. The construction shown in FIG. 14 corresponds to that shown in FIG. 11 with the difference that the shaft bar parts $46_e$ are hollow profiles each having a profile chamber 47 defined therein.

FIG. 15 shows a three-part handle shaft portion $46_f$ comprising two side bar parts 54 and a core or central bar part 55; between them FIG. 15 shows intermediate layers $50_k$ which are curved in a part-circular configuration relative to each other. Instead of the above-described plane E, two curved surfaces F can be seen herein.

Finally, FIG. 16 is a partial sectional view similar to FIG. 7 showing a plurality of hinge locations.

I claim:

1. A racket for ball games, in particular a tennis racket, comprising: a stringing frame including a shaped bar; stringing in the stringing frame; a throat region adjacent the stringing frame; a racket shaft and handle depending from the throat region, said handle having a handle end face defining a free end of the racket, and an intermediate limb portion on at least one of the handle and racket shaft; and a hinge location between the throat region and handle end, said hinge location having a hinge axis which extends parallel to the stringing, wherein the hinge location is formed by the intermediate limb portion and wherein said intermediate limb portion is delimited at least at one side thereof by a groove, wherein the hinge location is disposed in the region of the handle.

2. A racket according to claim 1 wherein the limb portion is delimited on two sides thereof by a groove.

3. A racket according to claim 1 wherein said racket has a longitudinal axis which forms a straight line of symmetry.

4. A racket according to claim 3 wherein the width of the groove-like channel as measured on the longitudinal axis of the racket is up to 100 mm.

5. A racket according to claim 4 wherein the thickness of the limb portion approximately corresponds to the depth of the groove.

6. A racket according to claim 4 wherein the thickness of the handle corresponds to between 4 and 10 times the thickness of the limb portion.

7. A racket according to claim 6 wherein the thickness of the handle corresponds to between 5 and 8 times the thickness of the limb portion.

8. A racket according to claim 1 wherein the hinge axis is disposed at a spacing of from 60 mm to 220 mm from the handle end.

9. A racket according to claim 1 wherein the groove-like channel is filled by a shaped mass.

10. A racket according to claim 1 wherein flexing of the racket under the action of a force which acts at a spacing of about 400 mm from the hinge axis towards the stringing is between 1.2 and 9 times as great as the flexing of a hinge-less racket which otherwise corresponds thereto when fixedly clamped at the handle as far as the hinge axis.

11. A racket for ball games, in particular a tennis racket, comprising: a stringing frame including a shaped bar; stringing in the stringing frame; a throat region adjacent the stringing frame; a racket shaft and handle depending from the throat region, said handle having a handle end face defining a free end of the racket, and an intermediate limb portion on at least one of the handle and racket shaft; and a hinge location between the throat region and handle end, said hinge location having a hinge axis which extends parallel too the stringing, wherein the hinge location is formed by the intermediate limb portion and wherein said intermediate limb portion is delimited at least at one side thereof by a groove, including a plurality of said hinge locations.

* * * * *